United States Patent [19]

Coast

[11] 4,180,256

[45] Dec. 25, 1979

[54] HIGH SPEED BAG FOLDING MACHINE

[75] Inventor: John B. Coast, Baton Rouge, La.

[73] Assignee: Union Carbide Corporation, New York, N.Y.

[21] Appl. No.: 920,051

[22] Filed: Jun. 28, 1978

[51] Int. Cl.[2] ..... B65H 45/18

[52] U.S. Cl. ..... 270/83; 93/84 R

[58] Field of Search ..... 270/62, 67, 69, 83; 93/84 R, 84 FF; 242/55, 67.1, DIG. 3; 53/118, 120

[56] References Cited

U.S. PATENT DOCUMENTS

| | | | |
|---|---|---|---|
| 2,877,612 | 3/1959 | Berney | 53/118 |
| 3,671,033 | 6/1972 | Coast | 270/83 |
| 3,711,086 | 1/1973 | Weist | 270/69 |
| 3,918,698 | 11/1975 | Coast | 270/69 |

*Primary Examiner*—Edgar S. Burr
*Assistant Examiner*—A. Heinz
*Attorney, Agent, or Firm*—Eugene Lieberstein

[57] ABSTRACT

In a bag folding machine of the type which includes a rolling section for winding the bag into a roll, with the rolling section divided into two sub-sections spaced a predetermined distance apart to form an open area therebetween through which the bag is withdrawn the improvement comprising; each sub-section including a rotatable mandrel forming a confined space with the moving surface of the rolling section, and means for rotating each mandrel at a peripheral speed about equal to the peripheral speed of the rolling section.

7 Claims, 3 Drawing Figures

HIGH SPEED BAG FOLDING MACHINE

The present invention relates to a machine for folding flexible plastic sheet material such as plastic bags and more particularly to an improvement in folding machines of the type which winds the bag into a roll and withdraws the rolled bag in a flattened state.

The present invention is specifically directed to folding machines of the type disclosed in U.S. Pat. No. 3,918,685, entitled "High Speed Machine And Method For Folding Plastic Bags And The Like" which issued on Nov. 11, 1975 in the name of John Coast and U.S. Pat. No. 3,671,033, entitled "Machine And Method For Folding Plastic Bags And The Like" which issued on June 20, 1972, also in the name of John Coast.

The above patents, the disclosures of which are herein incorporated by reference, each disclose the use of a rolling section which forms a curved moving surface disposed a minimum of 270° of a circle for winding the material into a roll. The rolling section is divided into at least two laterally separated sub-sections which are spaced apart to form an open unobstructed area therebetween for removing the rolled bag. Each sub-section is formed from a set of horizontally disposed parallel drive rollers whose axes are disposed a minimum of 270° of a circle to present on their inward inside and within each sub-section a moving surface throughout at least a substantial portion of the 270 degrees of a circle for driving the material into a roll. The rollers are arranged to form, in effect, a cul-de-sac having an entrance opening into which the material is fed for rolling. After the bag is rolled it is removed through the open area between the laterally spaced sub-sections.

Centrifugal force, bag material stiffness and the roll diameter contribute to the normal force which holds the bag against the inside surface of the cul-de-sac and guides the bag as it is wound into a rolled condition. Since the circumference of the cul-de-sac is directly proportional to the width of the flat folded rolled bag which is fixed for a given package carton size only the rolling speed remains variable. Heretofore the rolling speed was limited to a relatively low speed of below about 250 feet per minute representing a low bag folding rate. At higher rolling speeds the rolling capability of the machine deteriorates.

Applicant has discovered that in a machine for folding flexible sheet material, such as plastic bags, having rolling means for rolling the material into a roll, comprising, a rolling section arranged in an arc circumscribing at least about 270° of a circle for forming a cul-de-sac on its inward side having a moving curved surface throughout a substantial portion of said 270° for driving the material into a roll; the rolling capability of the machine may be significantly improved by limiting the free space about which the bag may roll within the rolling section to a narrow substantially annular region. This is preferably accomplished by incorporating a rotatable mandrel within the cul-de-sac of the rolling section leaving a predetermined open space between the mandrel and the moving surface against which the material may roll.

Accordingly, it is the principal object of the present invention to provide an improved folding machine for folding bags by rolling each bag into a roll and withdrawing each rolled bag in a flattened state, both at relatively high speed.

Other objects and advantages of the present invention will become apparent from the following detailed description of the invention when read in conjunction with the accompanying drawings of which:

Figure 1:
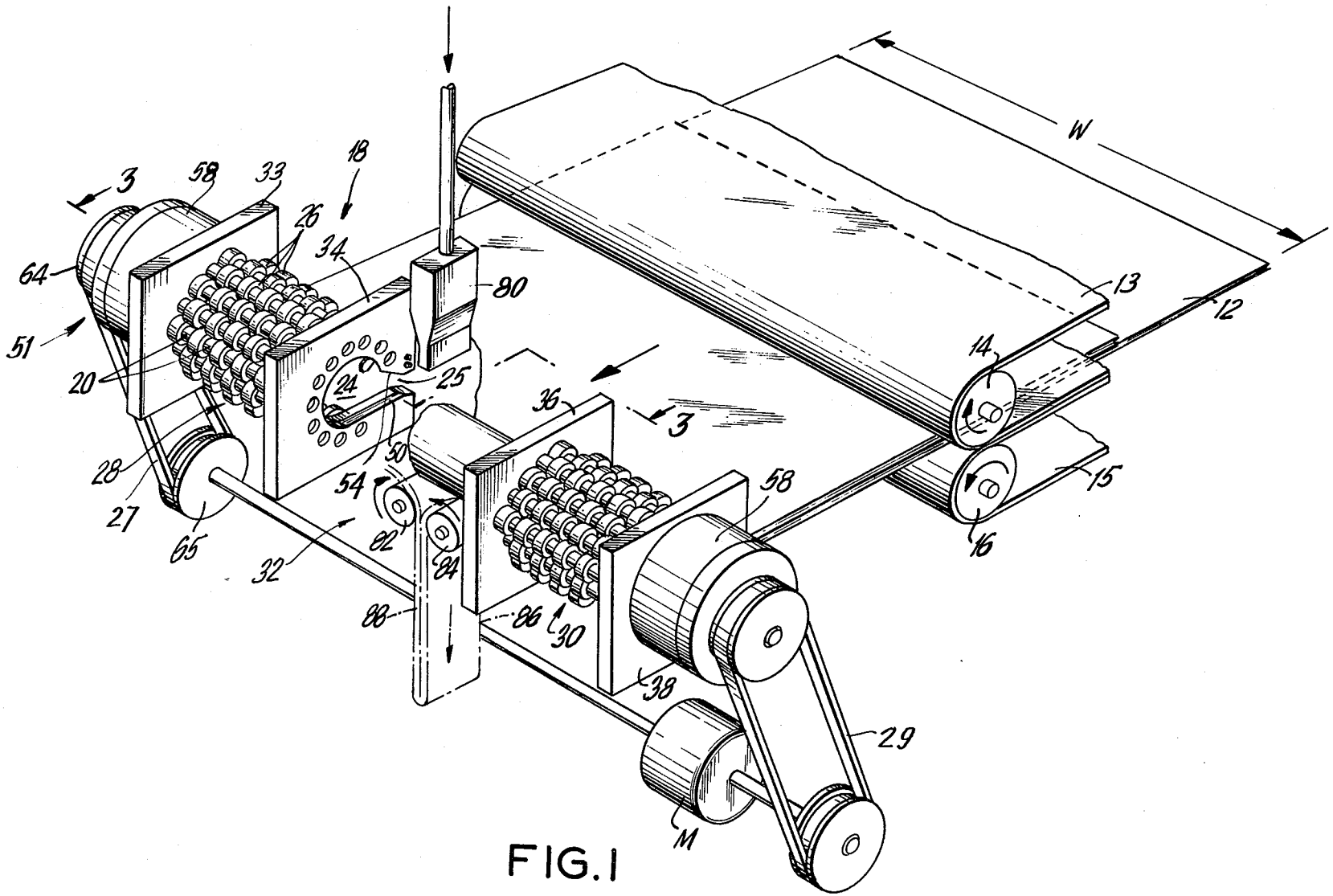
FIG. 1 is a perspective view of the folding machine of the present invention.
Figure 2:
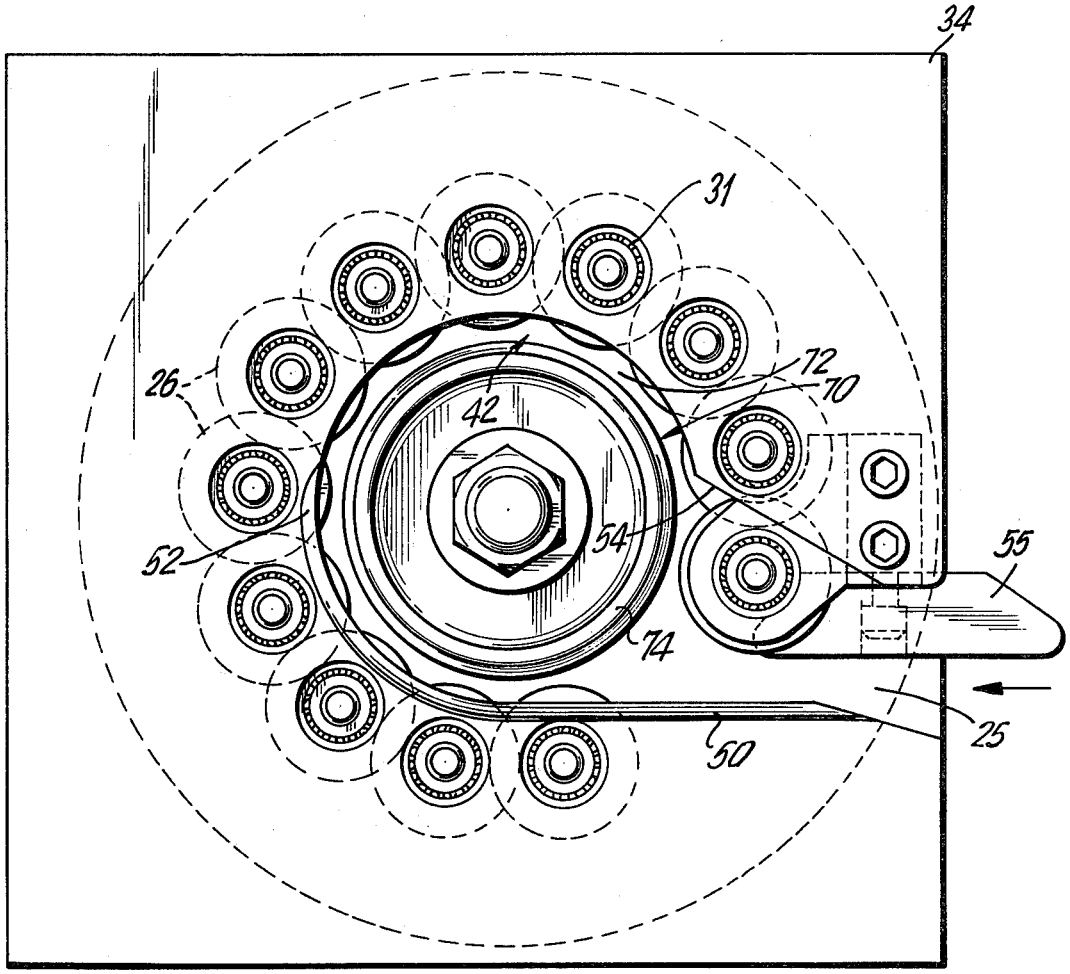
FIG. 2 is an end view of one of the rolling sub-sections of FIG. 1 observed from the open area between the sub-section.
Figure 3:
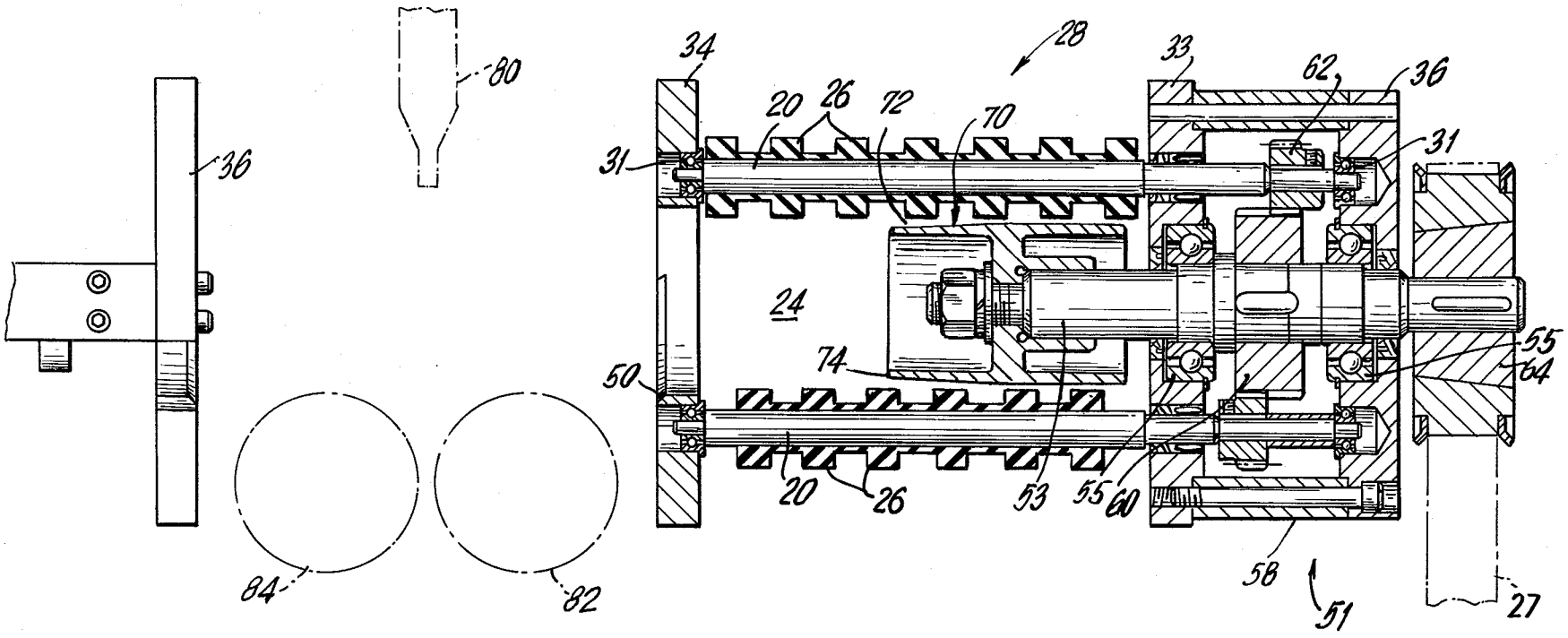
FIG. 3 is a partial sectional view of the folding machine taken along the lines 3—3 of FIG. 1.

Referring now to FIGS. 1–3 inclusive illustrating the improved folding machine of the present invention in which plastic bags are individually wound into a roll of tubular geometry and flat folded. It should be understood that the bags are formed from any suitable polymeric material using any conventional bag making operation. The preferred bag is the "U folded" side seam welded bag having a seamless bottom. Although the folding machine of the present invention is intended primarily for folding bags it is equally applicable for folding sheet goods of similar polymeric material.

As schematically illustrated in FIG. 1, a bag 12 is fed, at a predetermined speed, from a pair of endless belts 13 and 15 driven by drive rollers 14 and 16, into the rolling section 18 of the folding machine. Although the endless belts 13 and 15 have been shown in FIG. 1 spaced at a relatively substantial distance from the rolling section 18, it is preferred that they be positioned as close as possible to the entrance of the rolling section. The bag 12 may have already been prefolded any number of times to establish a predetermined width W preferably as taught in U.S. Application Ser. No. 829,926 entitled "A Multiple Folded Plastic Bag and Method" filed on Sept. 1, 1977, and now U.S. Pat. No. 4,151,787. A prefolded bag should be fed into rolling section 18 from its folded over end.

The rolling section 18 includes a series of drive rollers 20 having alternating protrusions 26 which interact with the bag to cause the bag, by a positive drive action, to be wound into a roll. The longitudinal axes of the rollers 20 are disposed at least 270° of a circle to form a cul-de-sac having a partial enclosure 24 of generally cylindrical configuration with a periphery defining the inside moving surface of the protrusions 26 for driving the bag 12 around into a roll. The cul-de-sac partial enclosure 24 leaves an opening 25, as best shown in FIG. 2, representing the entrance opening to the bag rolling section 18. Driving force is transmitted to the bag by friction between the elastomeric protrusions 26 of the drive rollers 20 and the bag itself.

To prevent the bag from escaping between the rollers 20, the protrusions 26 on each drive roller 20 interdigitate with protrusions 26 on adjacent drive rollers 20, as is best shown in FIGS. 1 and 2. The rollers 20 are fabricated by vulcanizing an elastomeric material to a shaft and subsequently grooving the elastomeric material to form the protrusions 26. The grooves between protrusions 26 have a width at least about ⅛" greater than the width of the protrusions 26 of adjacent rollers and a depth that will provide clearance for the protrusions of adjacent rollers. The degree of interdigitation of intermeshing can be controlled by varying the protrusion width, diameter or spacing and thereby the amount of overlap or intermesh. Friction characteristics of the system can of course also be varied by changing the elastomeric materials.

In order to permit the removal and flat folding of the rolled bag in the manner as hereafter explained, the rolling section 18 is centrally gapped, that is, it is divided into two preferably equal and separate sub-sections 28 and 30 respectively. The area 32 between the subsections 28 and 30 is thus basically an unobstructed open area. Although the sub-sections 28 and 30 are spaced from each other to establish the open area 32, they are intended to be driven from a single motor M which interconnects the drive rollers 20 of each subsection 28 and 30 for common rotation through belts 27 and 29. The arrangement of drive rollers 20 within each sub-section 28 and 30 is identical thereby forming an equivalent cul-de-sac geometry within each sub-section.

The drive rollers 20 as shown in FIG. 3 are rotatably supported in bearings 31 mounted within a pair of structural end plates 33, 34 and 36, 38 of each subsection 28 and 30 respectively. The drive rollers 20 are driven through a gearing assembly 51 associated with each sub-section 28 and 30 respectively. The gearing assembly 51 includes a shaft 53 rotatably supported in bearings 57 mounted within the gearing assembly housing 58. A sun gear 60 is fixedly mounted on the shaft 53 and engages a plurality of planet gears 62 secured to the drive rollers 20. The shaft 53 extends from each end of the housing 58 and is coupled at one end to a pulley 64 driven by the belt 27 which is coupled to the motor M through the pulley 65.

The opposite end of shaft 53 extends into the partial enclosure 24 formed by the cul-de-sac arrangement of drive rollers 20 in each sub-section 28 and 30 respectively. A mandrel 70 is connected to the shaft 53 for common rotation therewith. The mandrel 70 provides a limited free space 72 of predetermined geometry between its outer periphery and the protrusions 26, as best shown in FIG. 2 within which the bag 12 is free to roll. When the mandrel 70 is of a cylindrical geometry the free space 72 is annular. A desirable alternative is to slightly taper the mandrel 70, preferably starting from some intermediate point along its length as measured longitudinally, toward its front end 74. The mandrel 70 should preferably be of light weight and may be constructed from a metal such as aluminum. The mandrel 70 should not extend into the partial enclosure 24 too close to the end plate 34 and preferably should extend only about from one to two inches into the end of the rolled bag.

The free space 72 should provide a maximum distance measured radially from the periphery of the mandrel to the protrusion 26, as is shown in FIG. 2, equal to from about two to five times the total thickness of layers of film occupying the free space. In addition, the peripheral speed of the mandrel 70 should be generally equal to about the peripheral speed of the protrusion 26. The gear ratio between the sun gear 60 and the planets gears 62 may be chosen to achieve the relative speed.

Although it is preferred to drive the mandrel 70 from the shaft 53 it is within the contemplation of the present invention to drive the mandrel 70 directly from the drive rollers 20. In fact, it is not necessary for the mandrel to be coaxial with the longitudinal axis of the partial enclosure 24. Accordingly, the mandrel may be surface driven by using some of the protrusions 26 from only some of the drive rollers 20.

For high speed removal of the rolled bag it is preferred to withdraw the bag from the open area 32 in a direction substantially transverse to the direction of entry and to provide as much clearance as possible for conversion from a tubular to flat geometry. To achieve this the end plates 34 and 36 disposed on opposite sides of the open area 32 includes an aperture 42 having a contoured geometry as taught in a corresponding application U.S. Ser. No. 920,130 filed on even date herewith and entitled "Improved Bag Folding Machine", the disclosure of which is incorporated herein by reference. As taught therein and as shown in FIG. 2, the apertures 42 in end plates 34 and 36 are designed to have a contoured geometry including a substantially flat level bottom 50 lying substantially tangent to the moving surface of the cul-de-sac a curved portion 49 generally conforming to the outline of the moving surface of the partial enclosure 24 and terminating in an upper surface 54 lying at an angle inclined with respect to the bottom surface 50 so as to provide as much room as possible for the rolled bag 12 to transform its circular shape during extraction to an oval with the major axis parallel to the flat surface 50, thus minimizing wrinkling in the folded finished product.

The flat bottom surface 50 of each aperture 42, 42 has a beveled end 52 at the juncture with the open area 32. The beveled end 52 facilitates removal of the rolled bag from the open area 32. The bottom surface 50 provides a flat surface area over which the bag is forced during withdrawal and also serves as an extension of the entrance opening 25 for guiding the bag 12 into the subsections 28 and 30 respectively. Additional guide members 55, 55 associated with each sub-section 28 and 30 guide the incoming bag into the rolling section 18.

The rolled bag 12 is withdrawn from the rolling section 18 by applying a force to the rolled bag 12 in a discharge direction. The force is applied along the open area 32 preferably transverse to the direction in which the bag originally entered. The force is mechanically applied to the center of the rolled bag 12 preferably by a reciprocating tucker blade 80 which extends across the width of the rolling section. This causes the bag 12 to fold over while being driven between the nip rollers 82 and 84. The nip rollers flatten the bag and establish well defined folded edges 86 and 88. Thereafter, the folded bag may be refolded any number of additional times, if so desired, and packaged.

What is claimed is:

1. In a machine for producing folded flexible sheet material, such as plastic bags, having rolling means for rolling the material into a roll and means for removing the rolled material from said rolling means in a flattened condition, wherein said rolling means comprises; a rolling section arranged in an arc circumscribing at least 270° of a circle for forming a cul-de-sac having a moving curved surface through at least a substantial portion of said 270° and an entrance opening into which said material is fed, with said rolling section being divided into at least two laterally disposed sub-sections of substantially equal width spaced apart along a common longitudinal axis so as to provide a predetermined unobstructed opening therebetween and means for driving each sub-section; at a common speed sufficient to cause said material to wind about said moving curved surface into said roll, the improvement which comprises: a rotatable mandrel extending a predetermined distance within the cul-de-sac of each sub-section and having a periphery of predetermined geometry which maintains a minimum narrow free space between each mandrel and the moving curved surface of each sub-section; and means for rotating each mandrel at a peripheral speed about equal to the peripheral speed of said moving curved surface such that the rolling material is confined to said narrow free space.

2. In a machine as defined in claim 1 wherein said confined free space is annular in cross-section.

3. In a machine as defined in claim 1 or 2 wherein each mandrel has a periphery which is circular in cross-section.

4. In a machine as defined in claim 3 wherein each mandrel has a tapered periphery extending over at least a substantial portion of its length.

5. In a machine as defined in claim 4 wherein each mandrel is coaxial with the longitudinal axis of each sub-section.

6. In a machine as defined in claim 5 wherein each sub-section is formed from a series of drive rollers disposed in an arrangement forming said cul-de-sac with each drive roller having a multiplicity of protrusions which interdigitate with the protrusions on adjacent drive rollers and with the protrusions defining said moving curved surface in each sub-section and wherein said free space represents a radial distance between said protrusions and the periphery of said mandrel equal to from about two to five times the total thickness of the rolled material occupying said free space.

7. In a machine as defined in claim 6 wherein said means for driving each sub-section comprises a motor, and means connecting said motor in common with the drive rollers of each sub-section and with each mandrel.

* * * * *